US007625113B2

(12) United States Patent
Dillman et al.

(10) Patent No.: US 7,625,113 B2
(45) Date of Patent: Dec. 1, 2009

(54) ADJUSTABLE INLET FOR RECYCLE ASPHALT PAVEMENT

(75) Inventors: Bruce A. Dillman, Prairie du Chien, WI (US); Fredric W. Prill, North Aurora, IL (US)

(73) Assignee: AI Enterprises, Inc., Yankton, SD (US)

( * ) Notice: Subject to any disclaimer, the term of this patent is extended or adjusted under 35 U.S.C. 154(b) by 576 days.

(21) Appl. No.: 11/209,034

(22) Filed: Aug. 22, 2005

(65) Prior Publication Data

US 2007/0041265 A1 Feb. 22, 2007

(51) Int. Cl.
*B28C 5/46* (2006.01)

(52) U.S. Cl. ..... 366/25; 34/132; 432/111

(58) Field of Classification Search ..... 366/4, 366/7, 22–25; 34/132; 432/108–111
See application file for complete search history.

(56) References Cited

U.S. PATENT DOCUMENTS

| | | | | |
|---|---|---|---|---|
| 4,014,643 | A | | 3/1977 | Musha et al. |
| 4,075,710 | A | | 2/1978 | Jakob et al. |
| 4,136,964 | A | | 1/1979 | Swisher, Jr. |
| 4,136,966 | A | | 1/1979 | Mendenhall |
| 4,147,436 | A | | 4/1979 | Garbelman et al. |
| 4,240,754 | A | * | 12/1980 | Mendenhall ..... 366/4 |
| 4,940,334 | A | | 7/1990 | Musil |
| 5,088,856 | A | | 2/1992 | Yocum |
| 5,325,610 | A | | 7/1994 | Jou |
| 5,338,188 | A | | 8/1994 | Yocum |
| 5,470,146 | A | | 11/1995 | Hawkins |
| 5,558,432 | A | | 9/1996 | Swisher, Jr. |
| 5,664,882 | A | * | 9/1997 | Green et al. ..... 366/25 |
| 5,772,317 | A | | 6/1998 | Butler |
| 6,164,809 | A | | 12/2000 | Hawkins |
| 6,280,073 | B1 | | 8/2001 | Dillman |
| 6,672,751 | B2 | | 1/2004 | Hawkins |
| 2002/0131321 | A1 | | 9/2002 | Hawkins |
| 2004/0179422 | A1 | | 9/2004 | Hawkins |

* cited by examiner

*Primary Examiner*—David L Sorkin
(74) *Attorney, Agent, or Firm*—Ungaretti & Harris LLP

(57) ABSTRACT

A dryer (10) for an asphalt plant is disclosed. In one embodiment, the dryer (10) includes a generally cylindrical drum (12); a burner (20) having a burner head (22) at least partially disposed within the drum (12); a feeder (26) attached to a stationary portion of the dryer (10) for providing a recycled asphalt pavement; and an adjustable inlet (28) for introducing the recycled asphalt pavement from the feeder (26) into the drum (12) at a desired position. The adjustable inlet (28) is adjustable laterally between at least two positions.

12 Claims, 8 Drawing Sheets

ADJUSTABLE INLET FOR RECYCLE ASPHALT PAVEMENT

CROSS-REFERENCE TO RELATED APPLICATIONS

Not applicable.

FEDERALLY SPONSORED RESEARCH OR DEVELOPMENT

Not applicable.

TECHNICAL FIELD

The invention relates to drying a recycled asphalt pavement in a drum, and more particularly to a method and apparatus for adjusting the location of the inlet of the recycle asphalt pavement within a drum.

BACKGROUND OF THE INVENTION

Asphalt is typically produced in a drum by heat drying virgin aggregate and by adding to it and mixing with it liquid asphalt cement, fillers and other additives, often including reclaimed or recycled asphalt pavement (commonly referred to as RAP). Recycled and reclaimed asphalt pavement are commonly understood to be the same.

Typically, the virgin aggregate is introduced and heated in a direct fired dryer using super heated gasses and direct radiation from a burner flame, such as a counter-flow drum. This method is sufficient for virgin aggregate because no significant undesirable fumes are generated from heating the virgin aggregate as quickly as possible. Heating the RAP under similar conditions, in contrast, often generates undesirable fumes such as gaseous hydrocarbons and other chemicals and particulates. In many cases, if the RAP is heated in the direct fired dryer using direct radiation from the burner flame, visible smoke from the RAP is emitted from the asphalt plant.

In order to separate and minimize the undesirable fumes, others have utilized a mixing and drying drum or a large single drum and allowed the heated virgin aggregate to heat the RAP. In this approach, the RAP is introduced downstream of the volume heated by the burner head. The heated virgin aggregate heats the RAP without the use of direct radiation from the burner flame. This process may be acceptable in circumstances such as when the RAP has sufficiently low moisture content to permit it to be completely heated and dried in the processing time allowed for in a standard drum unit.

Another approach to heating the RAP is to build the asphalt plant with a recycle feed assembly that introduces the RAP into the drum downstream of the burner head. The RAP passes within the direct heat from the burner. However, depending upon the moisture content of the RAP, smoke and other undesirable gases and fumes may be created.

In general, if the RAP is naturally dry, it is desirable to introduce it into the mixing drum without exposure to the high heat of the burner flame. On the other hand, if the RAP has a high moisture content, then the RAP can withstand the direct heat to dry off the moisture efficiently; specifically, so long as the RAP is moist, it will not smoke when heated.

A need exists for a system permitting the adjustment of the location of the RAP feeder and/or RAP inlet to the drum. Adjusting the location of the RAP feeder and/or inlet permits the operator of the plant to tailor the unit to physical characteristics of the RAP such as moisture content, gradation of the RAP or other environmental factors. A further need exists for a system permitting the adjustment of the location of the combustion volume of the burner. A need also exists for a method of reducing the emissions during the operation of an asphalt plant.

The present invention is provided to solve the problems discussed above and other problems, and to provide advantages and aspects not provided by prior dryers of this type. A full discussion of the features and advantages of the present invention is deferred to the following detailed description, which proceeds with reference to the accompanying drawings.

SUMMARY OF THE INVENTION

In one embodiment of the present invention, a dryer for an asphalt plant is provided. The dryer includes a generally cylindrical drum, a burner, a feeder connected to a stationary portion of the dryer for providing a recycled asphalt pavement, and an adjustable inlet for introducing the recycled asphalt pavement from the feeder into the drum. The burner has a burner head disposed at least partially within the drum that generates a flame defining a combustion volume. The adjustable inlet is adjustable laterally between a first position above the combustion volume to a second position outside the combustion volume.

In accordance with another embodiment of the present invention, the dryer includes a generally cylindrical drum, a movable burner, and a recycled asphalt pavement inlet for introducing a recycled asphalt pavement into the drum. The movable burner has a burner head disposed at least partially within the drum for generating a flame that defines a combustion volume. The movable burner is movable laterally between a first position and a second position. The recycled asphalt pavement inlet introduces the recycled asphalt pavement above the combustion volume of the burner when the movable burner is in the first position, and the recycled asphalt pavement inlet introduces the recycled asphalt pavement outside of the combustion volume of the burner when the movable burner is in the second position.

Furthermore, in accordance with yet another embodiment of the present invention, a method of reducing emissions during operation of an asphalt plant is provided. The method includes introducing the recycled asphalt pavement into the drum at a first position. The method also includes examining a first amount of emissions emitted from the asphalt plant. Thereafter, when the first amount exceeds a threshold amount, the method further includes adjusting the location of the recycled asphalt pavement feeder to a second position. The second position is located between the first position and the outlet end of the drum.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
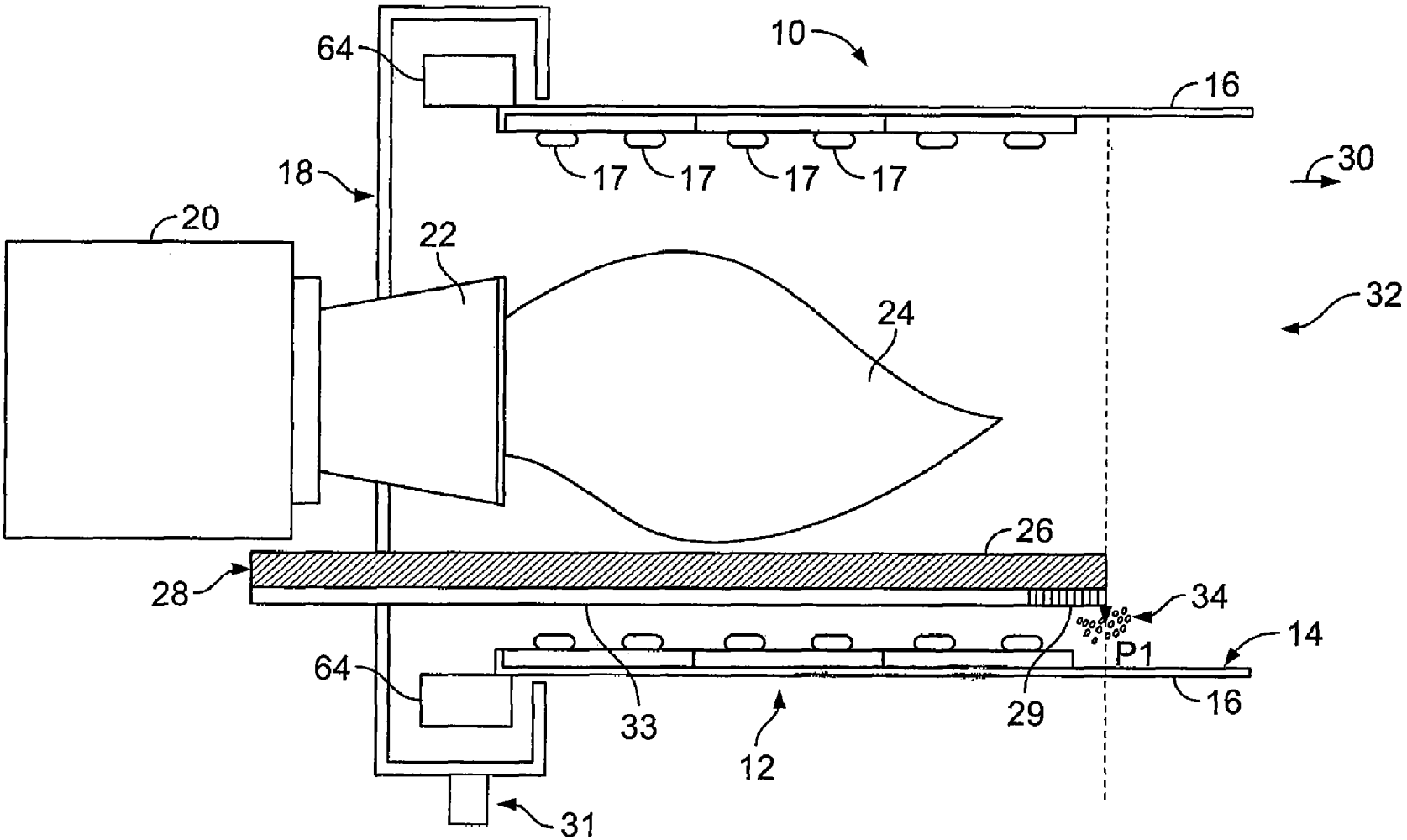
FIG. 1 is a schematic of a dryer having an adjustable inlet in a first position in accordance with one embodiment of the present invention.

While this invention is susceptible of embodiments in many different forms, there is shown in the drawings and will herein be described in detail preferred embodiments of the invention with the understanding the present disclosure is to be considered as an exemplification of the principles of the invention and is not intended to limit the broad aspects of the invention to the embodiments illustrated.

Referring to FIG. 1, a dryer 10 for an asphalt plant is shown. While the invention is described below in conjunction with a counter-flow asphalt plant, it is easily adaptable to use in a co-current flow asphalt plant. The dryer 10 includes single drum asphalt plants that include mixing and drying areas in a single drum. The dryer 10 may also be part of a DuoDrum or dual drum asphalt plant. In a DuoDrum asphalt plan, the mixing drum is separate from the dryer drum. In the DuoDrum asphalt plant, the mixing drum is typically connected to an outlet chute of the drying drum.

The dryer includes a drum 12, a burner 20, a feeder 26 and an adjustable inlet 28. As is known to those in the art, the drum 12 may also include an exhaust direction 30, an outlet chute 31 and aggregate inlet 32. The dryer 10 has an inlet end 14, an outlet end 18 and drum 12 has an interior surface 16. Narrow profile flights 17 may be present along the interior surface 16. The drum 12 is rotatable about its cylindrical axis. Sweeper flights 64 are present to move material into the outlet chute 31.

The burner 20 is disposed completely or at least partially within or near the outlet end of the dryer 10 and has a burner head 22 projecting into the drum. The burner head 22 generates a flame 24 completely within the drum 12 and the flame 24 defines a combustion volume within the drum 12. The burner head 22 is located between the inlet end 14 and the outlet end 18 of the dryer 10.

The feeder 26 provide a source of a recycled asphalt pavement 34. The recycled asphalt pavement 34 is introduced in the dryer 10 at the stationary outlet end 18 of the unit through the feeder 26, near where the burner 20 mounts. The feeder 26 is connected to a stationary portion of the dryer 10. The feeder 26 may be a screw conveyor. The screw conveyor feeds the recycled asphalt pavement by use of the threading on the screw. The screw conveyor runs through the length of the drum to the desired point of introduction of the recycled asphalt pavement. In some instances, a triple wall stainless steel tube or other insulating device should be used to protect the screw conveyor from the heat of the burner. The insulating device may use an air gap or other mechanism to provide adequate insulation for the screw conveyor. For single drum operations having an integral mixing zone, a conveyor is difficult to physically support because it must travel a long distance to reach the point of introduction of the recycled asphalt pavement, and thus is often undesirable.

The recycled asphalt pavement 34 initially has a certain moisture content. As is known in the art, a sample of the recycled asphalt pavement 34 may be tested to determine the approximate moisture content. Relatively dry recycled asphalt pavement 34 typically contains less than one percent moisture. Because of various reasons, such as that the recycled asphalt pavement 34 may be left outside for extended periods of time, the recycled asphalt pavement 34 may have some additional moisture content. Wet recycled asphalt pavement 34 typically contains five percent or more moisture. A medium moisture recycled asphalt pavement 34 has a moisture content of between one and five percent moisture therein, and may be approximately three percent moisture. The higher the moisture content of the recycled asphalt pavement 34, the more heat the recycled asphalt pavement 34 can withstand without creating any significant emissions such as smoke. It is believed that one reason for being able to withstand the heat of the flame for longer duration is that the moisture forms steam during heating. The steam protects against the asphalt in the recycled asphalt pavement 34 forming smoke.

Additionally, the recycled asphalt pavement 34 may be of different gradations. On one end of the spectrum, the recycled asphalt pavement 34 may consist of very fine particles. Very fine, individual particles are present when the recycled asphalt pavement 34 is relatively dry. As the recycled asphalt pavement 34 becomes wetter, the effective gradation becomes larger. For example, wet particles of the recycled asphalt pavement 34 will clump together or agglomerate, thereby forming agglomerations. When the recycled asphalt pavement 34 is finer, it can withstand less of the heat from the burner flame without emitting smoke. When the recycled asphalt pavement 34 contains more agglomerations, it does not heat as easily and efficiently and can be placed in the burner flame for a longer duration without generating smoke. Agglomerations do not heat as easily and efficiently because less surface area of the recycled asphalt pavement is exposed to the flame. One primary goal of the asphalt plant is that the recycled asphalt pavement 34 is dry upon exiting the plant.

Figure 2:
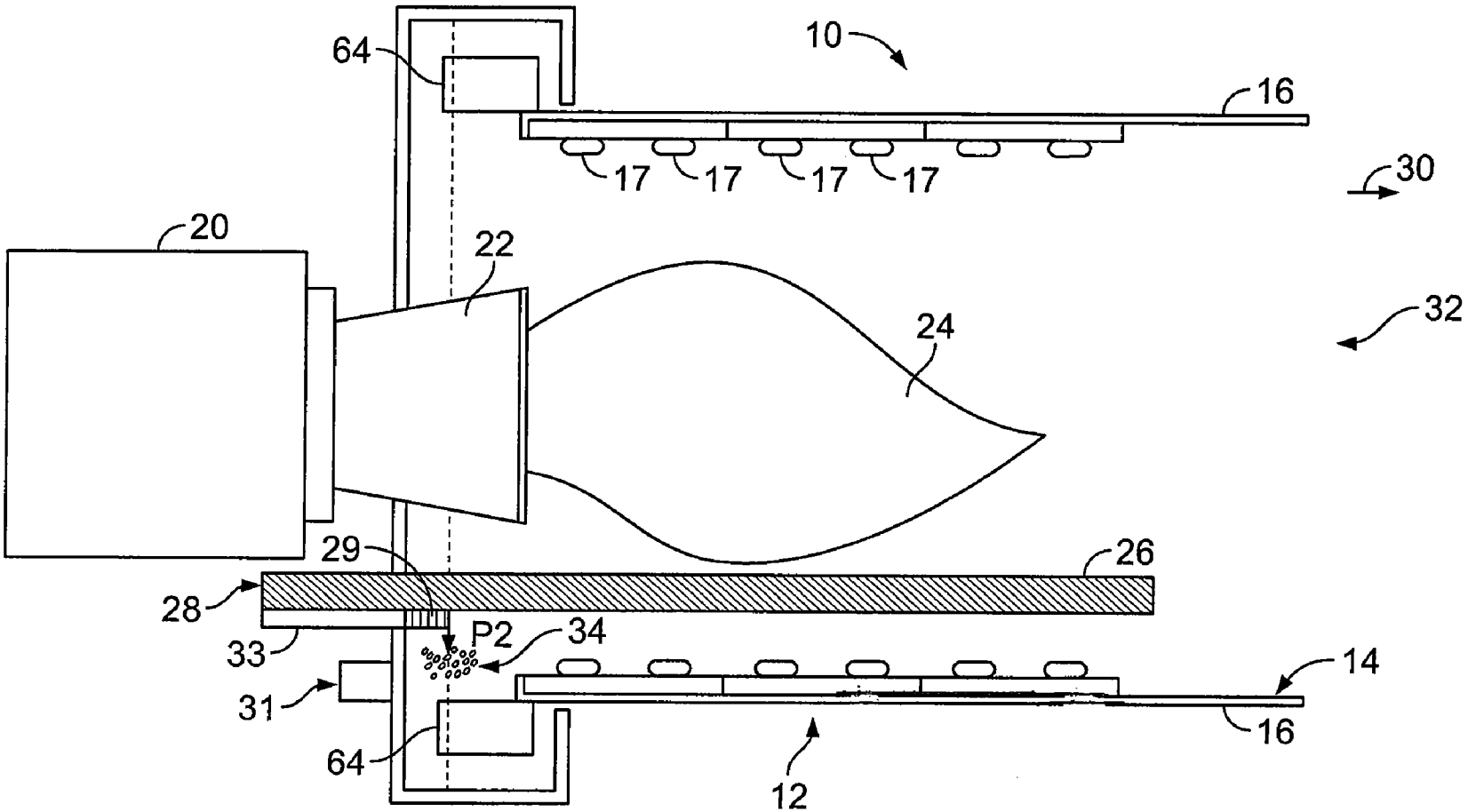
FIG. 2 is a schematic of a dryer having an adjustable inlet in a second position in accordance with one embodiment of the present invention.

The adjustable inlet 28 introduces the recycled asphalt pavement 34 from the feeder 26 into the drum 12 at a desired position. FIG. 1 illustrates the adjustable inlet 28 introducing the recycled asphalt pavement 34 into the drum 12 at a first position P1 above the combustion volume of the combustion flame 24. When the recycled asphalt pavement 34 is introduced at first position P1, the recycled asphalt pavement 34 is within the combustion volume and exposed to the burner flame. It will be understood by those of skill in the art that P1 may be any location between and including the inlet end of the drum 12 and the combustion volume of the combustion flame 24. FIG. 2 illustrates the adjustable inlet 28 introducing the recycled asphalt pavement 34 into the drum 12 at a second position P2 outside the combustion volume of the combustion flame 24. The adjustable inlet 28 is adjustable laterally within the drum from a first position P1 above the combustion volume of the combustion flame 24 to the second position P2 outside the combustion volume of the combustion flame 24. The adjustable inlet 28 is adjustable, in one embodiment, by any increment between these two positions. The first position P1 and the second position P2 may be separated by 6 to 9 feet or more. The distance of adjustability is related to the size of the asphalt plant.

Figure 3:
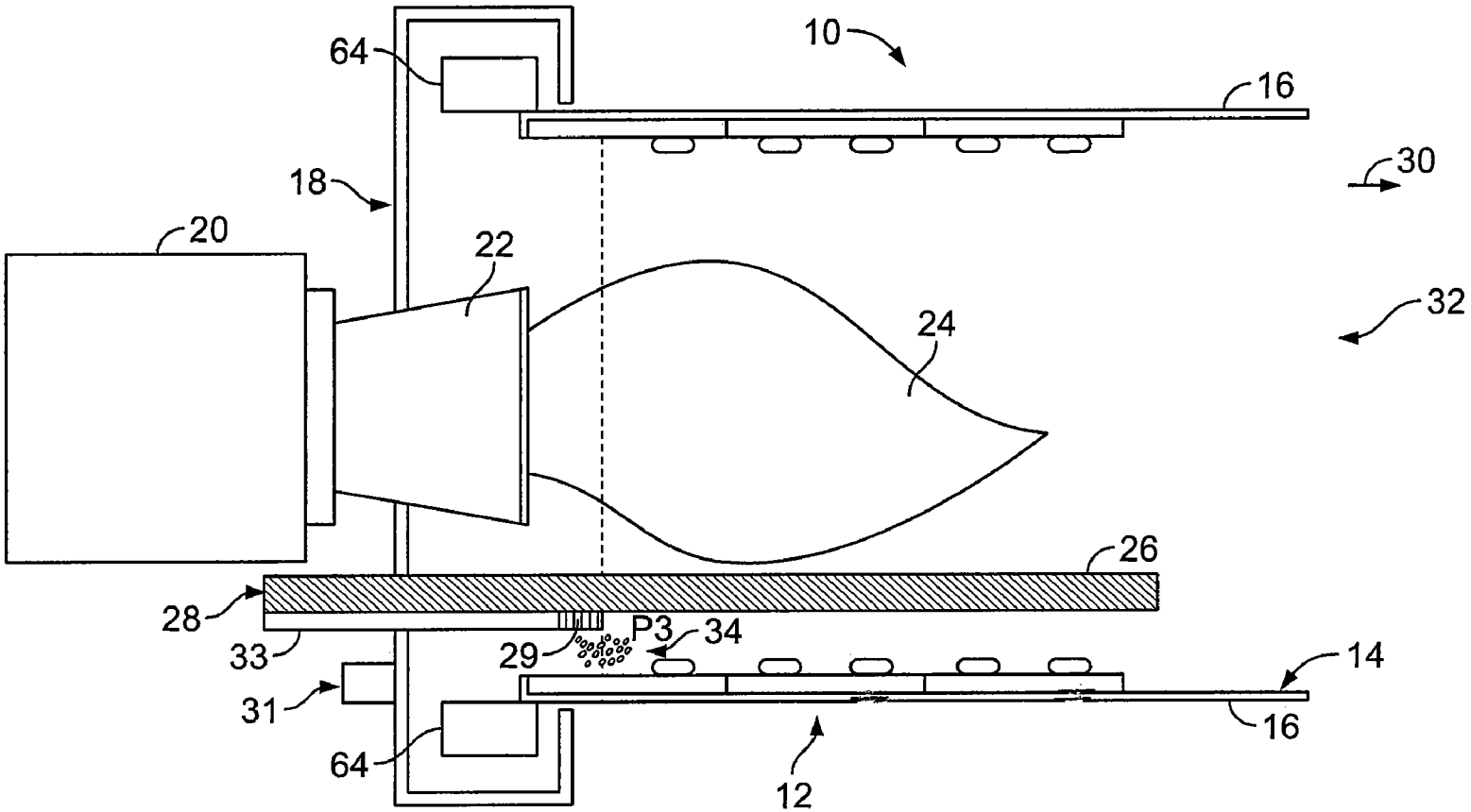
FIG. 3 is a schematic of a dryer having an adjustable inlet in a third position in accordance with one embodiment of the present invention.

The adjustable inlet 28 may also include a third position P3, shown in FIG. 3. The third position P3 is location located above the combustion volume of the combustion flame 24 and between the first and second positions P1 and P2.

When the recycled asphalt pavement is introduced within the combustion volume, as is known in the art, flights are often present. The flights secured to the interior of the drum act like paddles and mull the recycled asphalt pavement 34 to facilitate exposure of the recycled asphalt pavement 34 to the burner flame. In doing so, the flights aid in drying the recycled asphalt pavement 34. Further, the flights are routinely designed to reduce the amount of the recycled asphalt pavement 34 that falls into the flame since if the recycled asphalt pavement 34 falls into the flame, smoke is usually emitted.

In a preferred embodiment illustrated in FIGS. 1-3, the adjustable inlet 28 includes a slidable door 29. The door 29 is slidable across all or substantially all of the length of the conveyor or other feeder of the recycled asphalt pavement. A cylinder, piston or other device 33 may be utilized to cause the door 29 to slide. When the door 29 is slid into a certain desired position, it opens to permit the recycled asphalt pavement to enter the drum 12. Because the door 29 is slidable, the inlet position of the recycled asphalt pavement can be easily varied.

Figure 4:
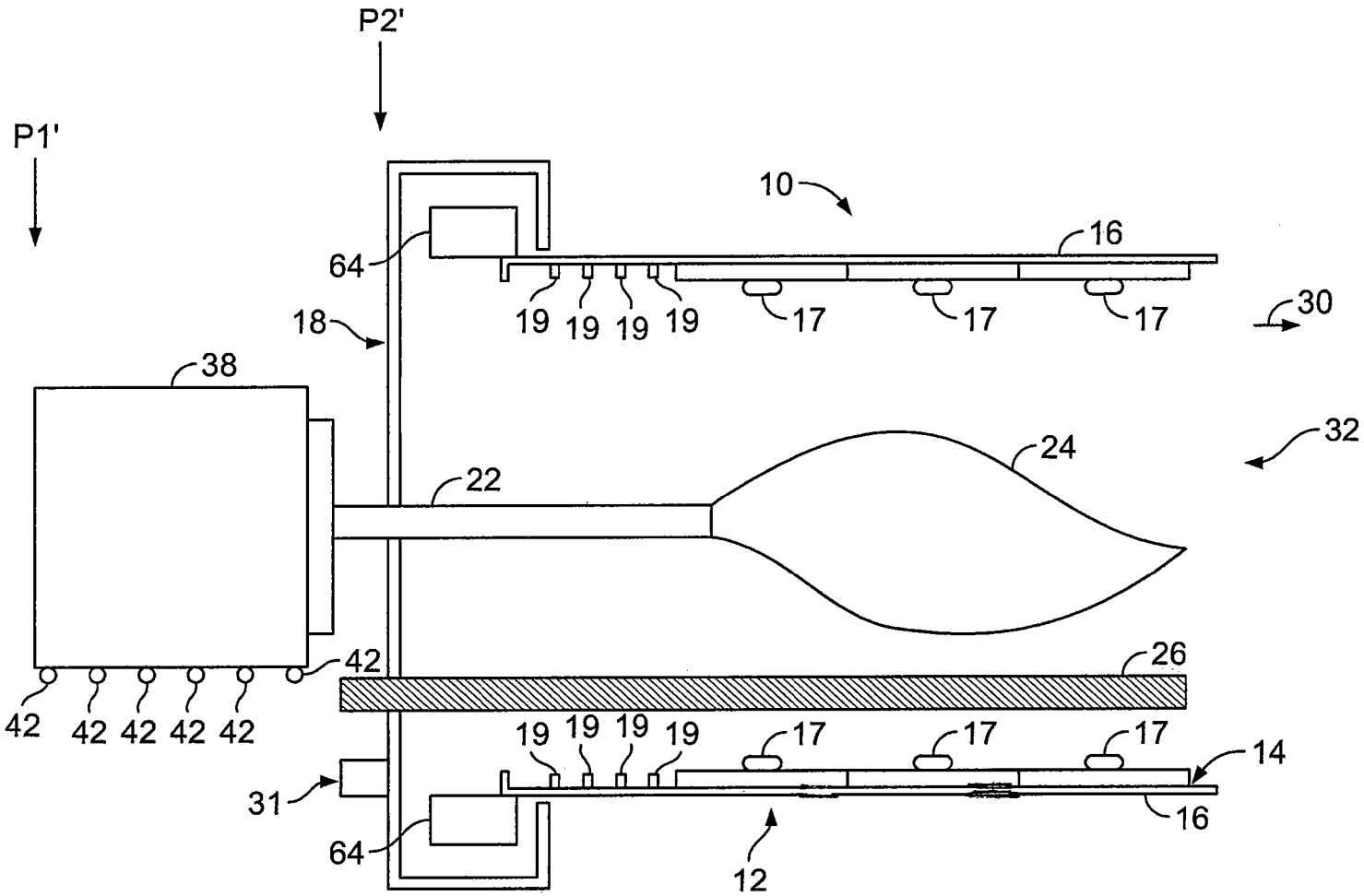
FIG. 4 is a schematic of a dryer having a movable burner in accordance with another alternative embodiment of the present invention; and, FIG. 5 is a schematic of a drying having a two-way chute in accordance with another embodiment of the present invention.

Turning now to FIG. 4, an alternative embodiment of the present invention is depicted. The dryer 10 for an asphalt plant is again disclosed. The dryer 10 comprises the drum 12, a movable burner 38 and a recycled asphalt pavement inlet 40. The dryer 10 has an inlet end 14, an outlet end 18 and drum 12 has an interior surface 16. The drum 12 is rotatable about its cylindrical axis. Narrow profile drying flights 17 are present, and downstream of the flame, mixing flights or paddles 19 may be used.

The movable burner 38 is disposed adjacent to or fully or partially within the drum 12 and has a burner head 23 located partially or completely within the drum 12 for generating a flame 24. The burner head 23 is typically elongated and extends a substantial amount into the drum 12. The flame 24 defines a combustion volume located between the inlet end 14 and the outlet end 18 of the dryer 10. The movable burner 38 is movable laterally within the drum between a first position P1' and a second position P2'. The movable burner 38 may include rollers 42. Instead of rollers 42, as will be understood by those of skill in the art, the burner may be moved by using greased slides the burner. Alternatively, a rack and pinion system or other arrangement as known in the art may be deployed. The movable burner 38 is desirable for use in a single drum asphalt plant.

The recycled asphalt pavement inlet 40 introduces a recycled asphalt pavement 34 into the drum 12. The recycled asphalt pavement inlet 40 introduces the recycled asphalt pavement 34 above the combustion volume of the burner 20 when the movable burner 38 is in the first position P1'. The recycled asphalt pavement inlet 40 introduces the recycled asphalt pavement 34 outside of the combustion volume of the burner 20 when the movable burner 38 is in the second position P2'. The recycled asphalt pavement 34 is first introduced into the unit by inlet 40 which is connected to a stationary portion such as end 18.

Figure 5:
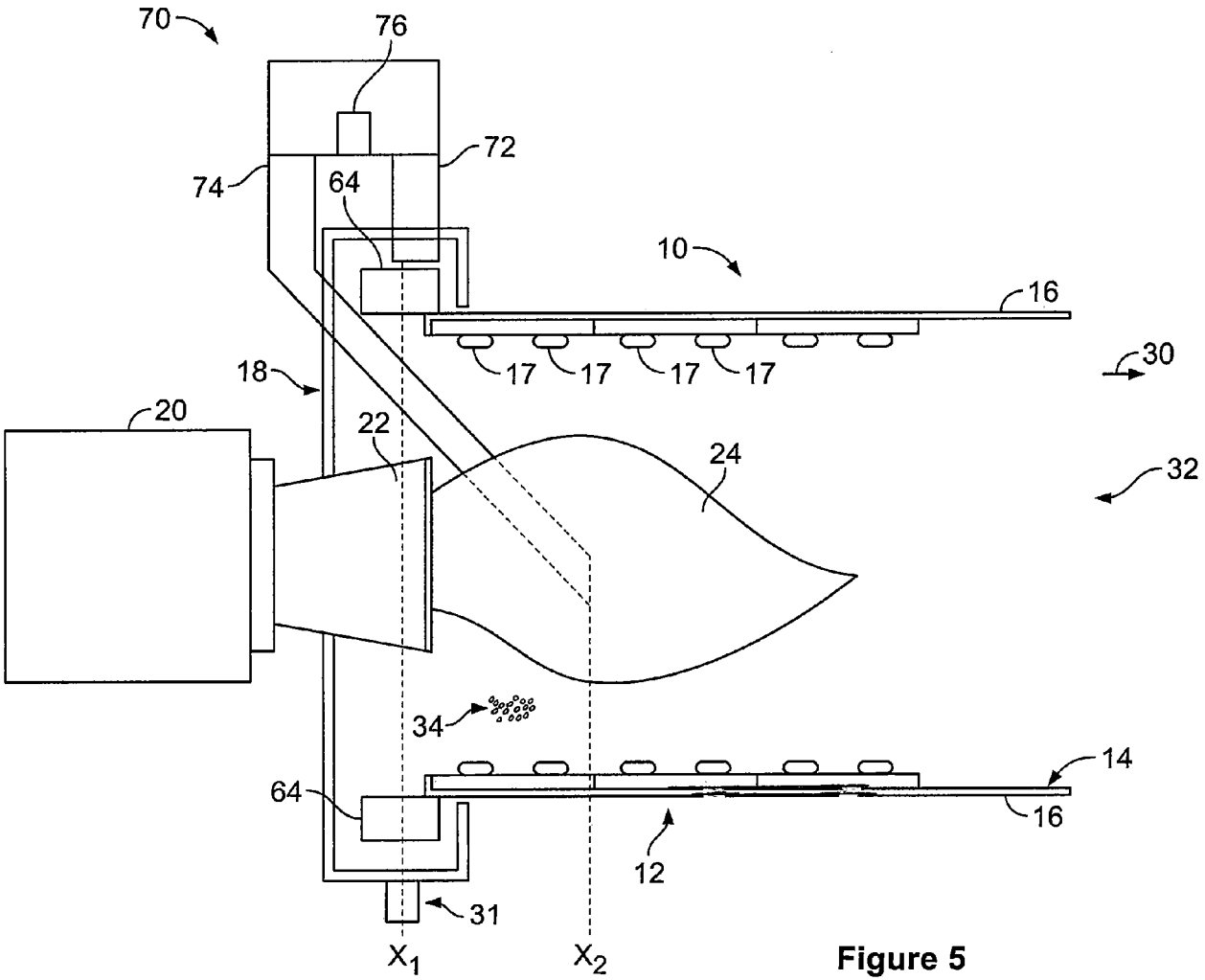

Another alternative embodiment is illustrated in FIG. 5. The embodiment of FIG. 5 is similar to embodiments shown in FIGS. 1-3, with the main difference being the use of a two-way chute 70 to introduce the recycled asphalt pavement 34 instead of a screw conveyor. Two-way chute 70 includes recycled asphalt pavement inlets 72 and 74. In one embodiment, inlet 72 introduces recycled asphalt pavement 34 outside the combustion volume at position $X_1$ and inlet 74 introduces recycled asphalt pavement 34 within the combustion volume at position $X_2$. Inlets 72 and 74 may be separated by two to three feet, for example, Two-way chute 70 is a flop chute that also includes a baffle or gate 76. Baffle or gate 76 can be controlled by an operator or automatically to select whether the recycled asphalt pavement 34 is introduced using inlet 72 or 74, depending upon the moisture and other qualities of the recycled asphalt pavement 34. The baffle or gate 76 covers the inlet 72 or 74 which is not in use. The recycled asphalt pavement 34 is introduced by chute 70 which is connected to the stationary end 18 of the unit. By introduction at the stationary end, large scoops attached to the inner surface of the rotating drum (which tend to require maintenance because of wear) are not necessary.

Figure 6A:
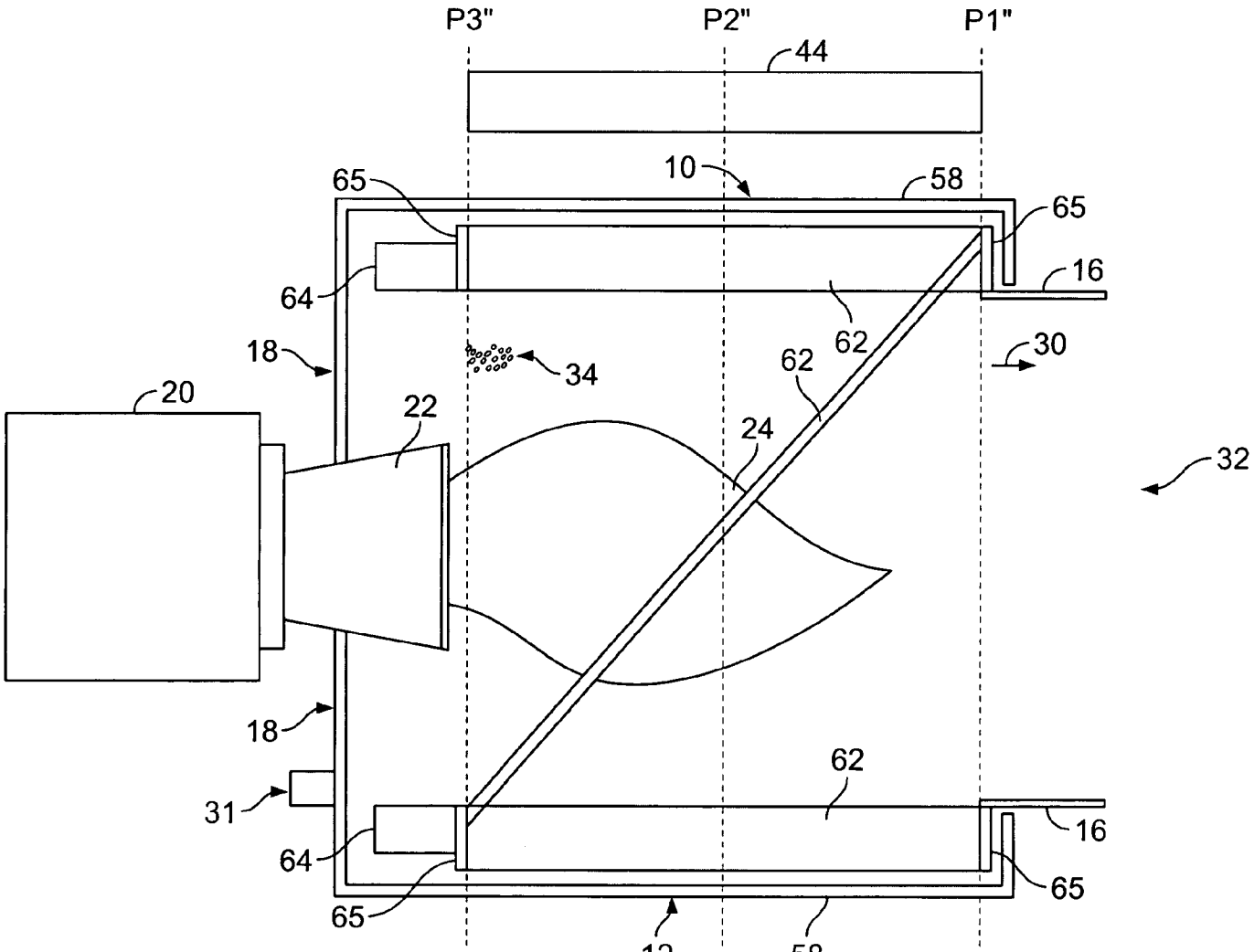
FIG. 6A is a schematic of a dryer in accordance with an alternative embodiment of the present invention.
Figure 6B:
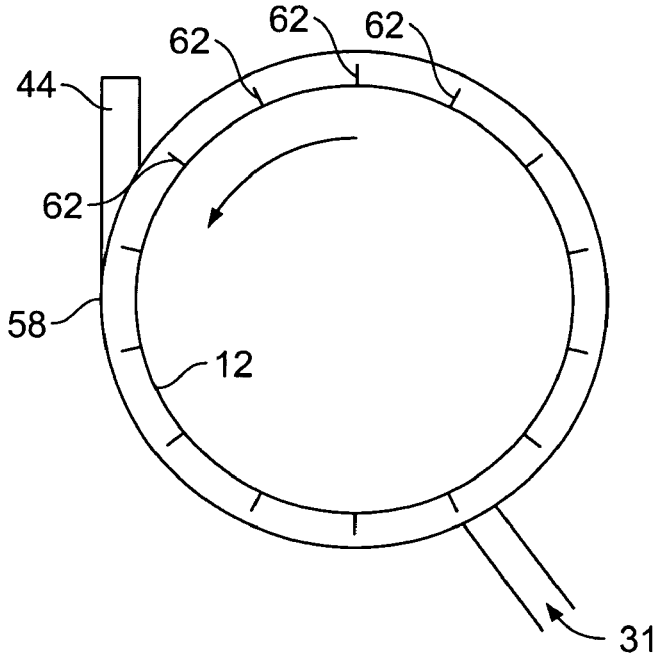
FIG. 6B is a sectional view of a dryer in accordance with an alternative embodiment of the present invention.

In an alternative embodiment of the present invention shown in FIGS. 6A and 6B, holes 60 are present in the inner surface of dryer 10. The holes 60 are typically are quite large and are present only in the area in which the recycled asphalt pavement 34 is introduced into the dryer 10. Standard flights as is known to those of skill in the art are present on the interior surface of the dryer 10. After the aggregate material has been heated, the aggregate materials passes through the holes 60 into an outer drum or shroud 58. The outer drum 58 is stationary, and in contrast with dryer 10, does not rotate. Material exits the drum at the outlet chute 31.

In this embodiment, the recycled asphalt pavement 34 is introduced into the outer drum 58. By any method, such as a three-way chute 44 or scoop, the recycled asphalt pavement 34 is introduced at an inlet which may be varied. The recycled asphalt pavement 34 and the aggregate material are exposed to the burner flame through the holes 60. Fin flights 62 are present in the outer drum to keep all of the material including both the recycled asphalt pavement 34 and the aggregate material moving toward the end of the outer drum 58. Fin flights 62 also expose material to the burner flame. The angle of the fin flights 62 are such that the fin flights 62 do not lift the material within the drum. The holes 60 represent a convenient way to mount the fin flights 62 to the outer drum. The recycled asphalt pavement 34 is effectively introduced at stationary outer drum 58 rather than at the rotating drum.

The fin flights 62 could be connected using donuts 65 tied to their ends. On one end, donut 65 is welded or otherwise secured to the surface of the drum 12. On the other end, donut 65 is connected to fin flights 62 or another structure. The donuts 65 rotate with the drum. Depending upon the moisture of the recycled asphalt pavement 34, the location of introduction of the recycled asphalt pavement 34 can be adjusted between positions P1", P2" and P3". According to this embodiment of the present invention, the recycled asphalt pavement 34 is prevented from overheating while in the presence of the burner flame.

Figure 7A:
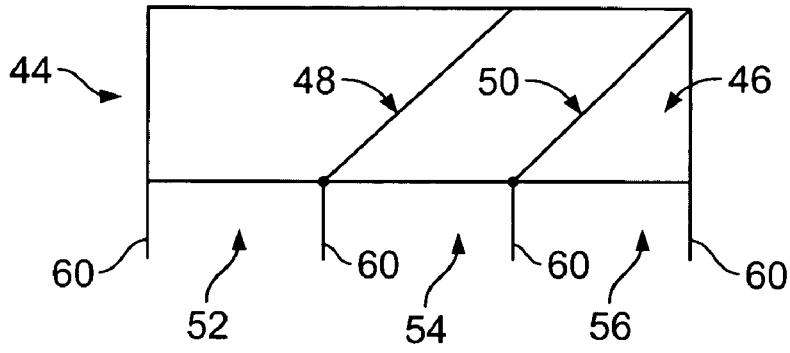
FIG. 7A is a schematic of a three-way chute with gates in a first orientation in accordance with the alternative embodiment of the present invention shown in FIGS. 6A and 6B.
Figure 7B:
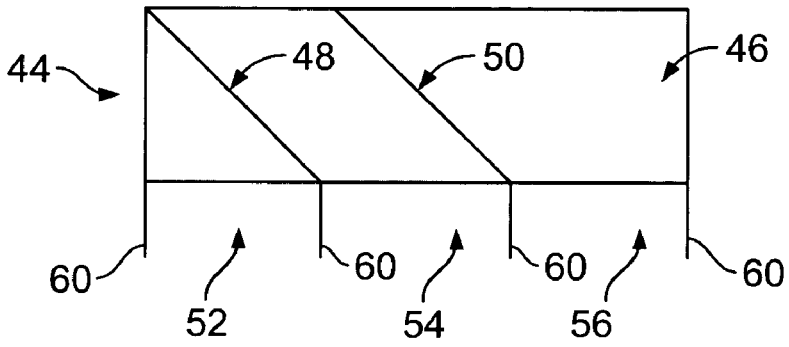
FIG. 7B is a schematic of a three-way chute with gates in a second orientation in accordance with the alternative embodiment of the present invention shown in FIGS. 6A and 6B.
Figure 7C:
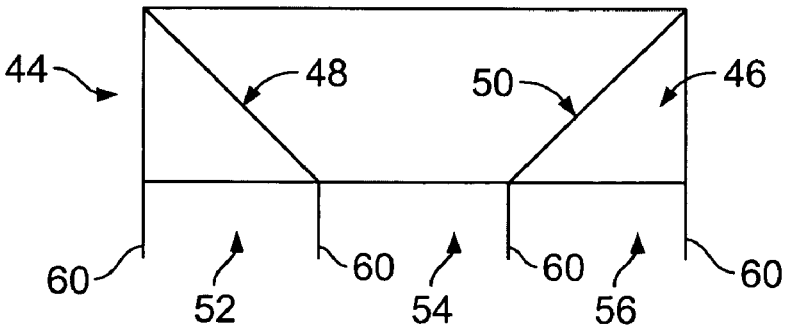
FIG. 7C is a schematic of a three-way chute with gates in a third orientation in accordance with the alternative embodiment of the present invention shown in FIGS. 6A and 6B.

The adjustable inlet 28 comprises a three-way chute 44 as illustrated in FIGS. 7A, 7B and 7C. Three-way chute 44 includes an upper portion 46, gates or plates 48, 50 and compartments 52, 54, 56. The recycled asphalt pavement 34 is provided from feeder 26 into three-way chute 44 through the upper portion 46. The upper portion 46 is generally open and permits the recycled asphalt pavement to pass therethrough. The gates 48, 50 are solid, structural and substantially planar flaps that extend from the top of upper portion 46 to the bottom of upper portion 46. Typically, the gates 48, 50 are formed of wear-resistant steel and will not break or deform as the recycled asphalt pavement passes along the gates. The gates 48, 50 are movable to permit three-way chute 44 to operate. The compartments 52, 54, 56 are typically each one to two feet in width, although this may be larger or smaller depending upon the size of the asphalt plant. Dividing walls 60 separate the compartments 52, 54 and 56.

In a first orientation, the first gate 48 is positioned down and the second gate 50 is positioned up (as illustrated in FIG. 7A). In the first orientation, the recycled asphalt pavement 34 is directed into a first compartment 52. In a second orientation as shown in FIG. 7B, the first gate 48 is positioned up and the second gate 50 is positioned down. In the second orientation, recycled asphalt pavement is directed into and thru the third compartment 56. In a third orientation (as shown in FIG. 7C), both of the gates 48 and 50 are positioned up. In the third orientation, the recycled asphalt pavement is directed into the second compartment 54.

The three orientations correspond to three positions of entry of the recycled asphalt pavement 34 into the drum 12. The first compartment 52 is typically used for wet recycled asphalt pavement to maximize heating time. The second compartment 54 is typically used for medium recycled asphalt pavement. The third compartment 56 is typically used for dry recycled asphalt pavement to prevent smoke and other emissions.

The dryer 10 may also include a control mechanism. The control mechanism is connected to the adjustable inlet 28. The control mechanism controls the position of the adjustable inlet 28. The control mechanism may be manually operated or automated. The manual operation of the control mechanism may be performed by use of a lever or other device as is known to those of skill in the art.

The present invention is capable of being utilized to reduce the emissions during operation of an asphalt plant. For example, the asphalt plant previously described with an adjustable inlet may be provided. The method includes introducing the recycled asphalt pavement into the drum. The recycled asphalt pavement is introduced into the drum at a first position. In one embodiment, the first position is selected based upon the moisture content of the recycled asphalt pavement. The more moisture in the recycled asphalt pavement, the further upstream the recycled asphalt pavement is introduced in the drum. The first position may be selected based upon the gradation of the recycled asphalt pavement. The finer the particles of the recycled asphalt pavement, the further downstream the recycled asphalt pavement is introduced to avoid creating smoke. The first position may also be selected based upon various other concerns such as local, regional or national environmental laws, the operating conditions such as ambient temperature and other factors.

The method also includes examining a first amount of emissions emitted from the asphalt plant. These emissions may include visible emissions, odorous emissions, other undesirable emissions or any combination thereof. The examining the first amount of emissions step may be visually inspecting a surrounding sky of the asphalt plant, or may involve more complex readings.

The method further includes that, after examining the first amount of emissions emitted from the asphalt plant, when the first amount exceeds a threshold amount, adjusting the location of the recycled asphalt pavement feeder to a second position. The second position being located between the first position and the outlet end of the drum. In one embodiment, the second position is outside the combustion volume of the burner and the first position is above the combustion volume of the burner.

The method may be repeated (including both the examining and adjusting steps) until the first amount is less than the threshold amount.

When the recycled asphalt pavement comprises greater than five percent moisture, the recycled asphalt pavement may be placed directly in the combustion flame of the burner head. When the recycled asphalt pavement comprises less than one percent moisture, the recycled asphalt pavement should not be placed in the combustion flame, but rather downstream of the combustion flame. When the recycled asphalt pavement comprises approximately three percent moisture, the recycled asphalt pavement may be placed in the combustion flame, but not for as long as with the five percent moisture.

The present invention also includes introducing the recycled asphalt pavement into the unit at the stationary portion of the dryer rather than through the wall of the rotating drum. This is accomplished by the use of a structure such as a screw conveyor that is connected to the stationary end and does not rotate. Large scoops are necessary if the recycled asphalt pavement is introduced into the rotating drum. The scoops, because they are immobile, do not permit numerous positions of recycled asphalt pavement introduction.

While the specific embodiments have been illustrated and described, numerous modifications come to mind without significantly departing from the spirit of the invention, and the scope of protection is only limited by the scope of the accompanying claims.

What is claimed is:

1. A dryer for an asphalt plant comprising:

a generally cylindrical drum rotatable about its cylindrical axis having first and second ends and an interior surface;

a burner having a burner head disposed at least partially within the drum for generating a flame extending outwardly from the burner from a proximal end to a distal end in a direction from the second end of the drum towards the first end of the drum and defining a combustion volume located between the first and second ends of the drum;

a feeder connected to a stationary portion of the dryer for providing a recycled asphalt pavement; and, an adjustable and laterally traversable inlet for introducing the recycled asphalt pavement from the feeder into the drum at a plurality of variable positions, the adjustable and laterally traversable inlet being adjustable laterally between a first position located between the distal end of the flame and the first end of the drum and a second position located between the proximal end of the flame and the second end of the drum.

2. The dryer of claim 1, wherein the adjustable and laterally traversable inlet for introducing the recycled asphalt pavement from the feeder into the drum further includes a third position located between the proximal and distal ends of the flame and between the first and second positions of the adjustable and laterally traversable inlet.

3. The dryer of claim 1, wherein the feeder comprises a screw conveyor.

4. The dryer of claim 1, wherein the adjustable and laterally traversable inlet comprises a slidable door.

5. The dryer of claim 1, wherein the adjustable and laterally traversable inlet is adjustable over a distance of at least nine feet.

6. The dryer of claim 1, further comprising a control mechanism connected to the adjustable and laterally traversable inlet, the control mechanism controlling the position of the adjustable and laterally traversable inlet.

7. The dryer of claim 6, wherein the control mechanism is automated.

8. The dryer of claim 1, wherein the adjustable and laterally traversable inlet comprises a two-way chute.

9. The dryer of claim 1, wherein the adjustable and laterally traversable inlet comprises a three-way chute.

10. The dryer of claim 9, wherein the three-way chute comprises a pair of movable gates.

11. A dryer for an asphalt plant comprising:

a generally cylindrical drum rotatable about its cylindrical axis having first and second ends and an interior surface;

a movable burner having a burner head disposed at least partially within the drum for generating a flame extending outwardly from the burner from a proximal end to a distal end in a direction from the second end of the drum towards the first end of the drum and defining a combustion volume located between the first and second ends of the drum, the movable burner being movable laterally between a first position and a second position; and, a recycled asphalt pavement inlet connected to a stationary portion of the dryer for introducing a recycled asphalt pavement into the drum, wherein the recycled asphalt pavement inlet introduces the recycled asphalt pavement between the distal end of the flame and the first end of the drum when the movable burner is in the first position, and the recycled asphalt pavement inlet introduces the recycled asphalt pavement between the proximal end of the flame and the second end of the drum when the movable burner is in the second position.

12. The dryer of claim 11 wherein the movable burner includes rollers.

* * * * *